US011450961B1

(12) United States Patent
Song et al.

(10) Patent No.: US 11,450,961 B1
(45) Date of Patent: Sep. 20, 2022

(54) SPOILER INTEGRATED COMPACT AND LOW PROFILE AM/FM AND DAB ANTENNAS

(71) Applicant: GM Global Technology Operations LLC, Detroit, MI (US)

(72) Inventors: Hyok Jae Song, Oak Park, CA (US); Hanseung Lee, Thousand Oaks, CA (US); Nahel Eshaq, Rochester, MI (US); Gregg R. Kittinger, Oakland, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/200,781

(22) Filed: Mar. 13, 2021

(51) Int. Cl.

| | |
|---|---|
| ***H01Q 5/49*** | (2015.01) |
| ***H01Q 1/32*** | (2006.01) |
| ***H01Q 9/04*** | (2006.01) |

(52) U.S. Cl.
CPC ..... *H01Q 5/49* (2015.01); *H01Q 1/3275* (2013.01); *H01Q 9/0414* (2013.01)

(58) Field of Classification Search
CPC ..... H01Q 1/32; H01Q 1/3275; H01Q 5/30; H01Q 5/49; H01Q 9/0414
See application file for complete search history.

(56) References Cited

U.S. PATENT DOCUMENTS

| | | | |
|---|---|---|---|
| 7,038,630 B1 | 5/2006 | Bally et al. | |
| 8,537,062 B1 | 9/2013 | Duzdar et al. | |
| 10,056,686 B2 | 8/2018 | Park et al. | |

FOREIGN PATENT DOCUMENTS

| | | | | |
|---|---|---|---|---|
| CN | 206059635 U | * | 3/2017 | ..... H01Q 1/32 |
| EP | 3176871 A1 | * | 6/2017 | ..... H01Q 1/22 |
| JP | 2017168938 A | * | 9/2017 | ..... H01Q 1/32 |

* cited by examiner

*Primary Examiner* — Hoang V Nguyen
(74) *Attorney, Agent, or Firm* — Cantor Colburn LLP

(57) ABSTRACT

A vehicle includes a spoiler and an antenna assembly for the vehicle. The spoiler includes a support surface and a cover attachable to the support surface to form a cavity with the support surface. The antenna assembly includes a circuit board, antenna and support beam. The circuit board is attachable to the support surface. The support beam extends from the circuit board and the antenna is at an end of the support beam opposite the circuit board. The antenna is disposed within the cavity.

18 Claims, 4 Drawing Sheets

SPOILER INTEGRATED COMPACT AND LOW PROFILE AM/FM AND DAB ANTENNAS

The subject disclosure relates to an antenna assembly suitable for a vehicle and in particular to an antenna assembly that can be contained within a spoiler of the vehicle.

Vehicles generally include an entertainment system, such as a radio, which receives signals being broadcast over the airwaves. An antenna is required to pick up these signals for the radio. The low frequency antenna is generally a rod-like structure extending from the surface of the hood or roof of the vehicle. In such a configuration, the antenna is exposed to outside forces or objects that can cause damage to it. In another configuration, the low frequency antenna is printed on a vehicle glass. However, this configuration degrades an aesthetic quality of the vehicle. Accordingly, it is desirable to shield the antenna from these outside forces or objects.

SUMMARY

In one exemplary embodiment, an antenna assembly for a vehicle is disclosed. The antenna assembly includes a circuit board a circuit board attachable to a support surface of a spoiler of the vehicle, the support surface forming a cavity with a cover of the spoiler, a support beam extending from the circuit board, and an antenna at an end of the support beam opposite the circuit board, wherein the antenna is disposed within the cavity.

In addition to one or more of the features described herein, the antenna includes at least one of an AM/FM radio frequency antenna and a digital audio broadcast (DAB) antenna. The antenna extends along a length of the cavity. The support beam supports the antenna at a location near the cover. The support surface is at about a 45-degree angle from horizontal. The antenna is a folded antenna. The cover is one of electrically non-conductive and electrically non-conductive with an electrically conductive layer of paint.

In another exemplary embodiment, a spoiler for a vehicle is disclosed. The spoiler includes a support surface, a cover attachable to the support surface to form a cavity, and an antenna assembly disposed within the cavity.

In addition to one or more of the features described herein, the antenna assembly includes a circuit board attachable to the support surface, a support beam extending from the circuit board, and an antenna at an end of the support beam opposite the circuit board, wherein the antenna is disposed within the cavity. The antenna includes at least one of an AM/FM radio frequency antenna and a digital audio broadcast (DAB) antenna. The antenna extends along a length of the cavity. The support beam supports the antenna at a location near the cover. The antenna is a folded antenna. The cover is one of electrically non-conductive and electrically non-conductive with an electrically conductive layer of paint.

In yet another exemplary embodiment, a vehicle is disclosed. The vehicle includes a spoiler having a support surface and a cover attachable to the surface to form a cavity, and an antenna assembly disposed within the cavity.

In addition to one or more of the features described herein, the antenna assembly includes a circuit board attachable to the support surface, a support beam extending from the circuit board, and an antenna at an end of the support beam opposite the circuit board, wherein the antenna is disposed within the cavity. The antenna includes at least one of an AM/FM radio frequency antenna and a digital audio broadcast (DAB) antenna. The antenna extends along a length of the cavity. The support beam supports the antenna at a location near the cover. The antenna is a folded antenna.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
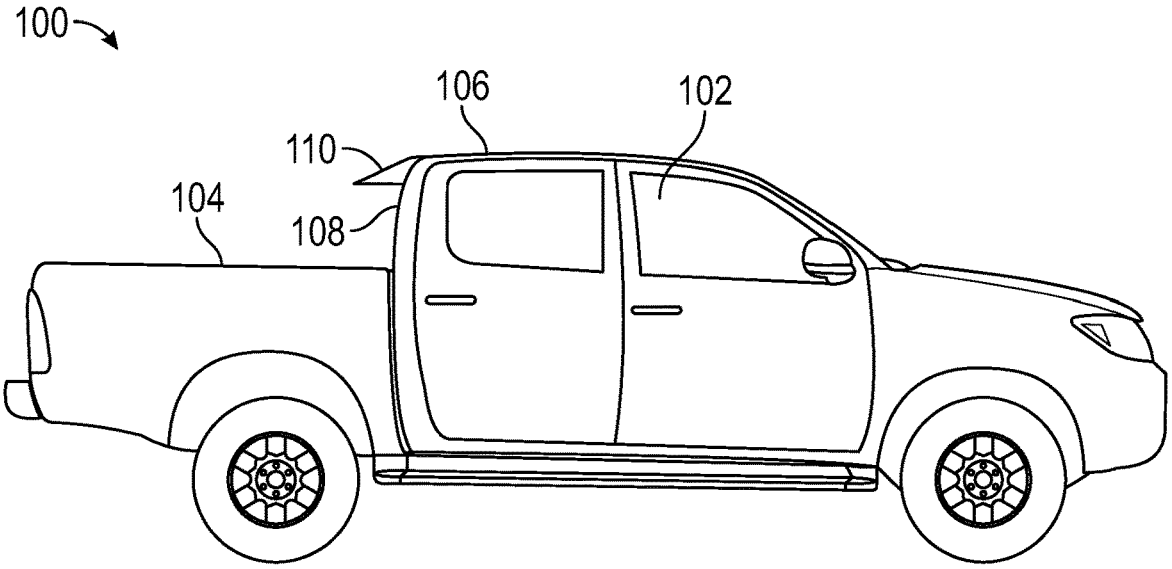
FIG. 1 shows a vehicle suitable for concealment of an antenna assembly for radio communications, in an embodiment.

The following description is merely exemplary in nature and is not intended to limit the present disclosure, its application or uses. It should be understood that throughout the drawings, corresponding reference numerals indicate like or corresponding parts and features.

In accordance with an exemplary embodiment, FIG. 1 shows a vehicle 100 suitable for concealment of an antenna assembly for radio communications. In an embodiment, the vehicle 100 is a pickup truck including, among others, a cabin 102 and a truck bed 104. A roof 106 of the cabin 102 is located a vertical distance above the truck bed 104. A back surface 108 of the cabin 102 extends from the roof 106 to the truck bed 104 and provides a vertical face between the roof and truck bed. A spoiler 110 is located at the top and rear of the roof 106 and extends towards the rear of the vehicle 100. Without the spoiler 110, a flow of air passing over the roof 106 is interrupted at the back surface 108 and creates a turbulent region behind the cabin 102 that introduces a drag on the vehicle 100. The presence of the spoiler 110 directs the flow of air passing over the roof 106 along a smoother path and thereby reduces the turbulence behind the cabin 102 and the resulting drag on the vehicle 100.

Figure 2:
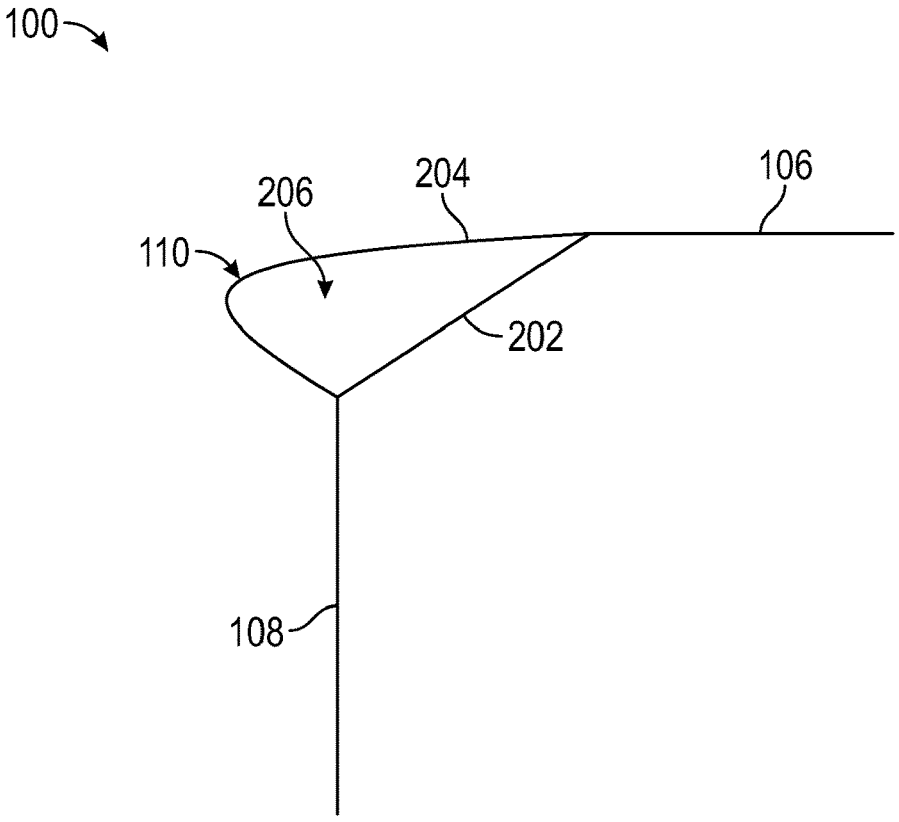
FIG. 2 shows a side-sectional view of a spoiler of the vehicle of FIG. 1.

FIG. 2 shows the spoiler 110 of FIG. 1 from a side view. The spoiler 110 includes a support surface 202 affixed to the roof 106 of the vehicle 100. The support surface 202 has a planar face that is generally at an angle from about 40 degrees to about 45 degrees from a horizontal plane representative of the roof 106. A cover 204 is coupled to the support surface 202 via one or more securing devices (not shown). When attached or secured to the support surface 202, the cover 204 forms an enclosed region 206 or chamber between the support surface 202 and the cover 204. In various embodiments, the cover 204 is electrically non-conductive. However, the cover 204 can also include a layer of paint on its outside surface that can be electrically conductive.

Figure 3:
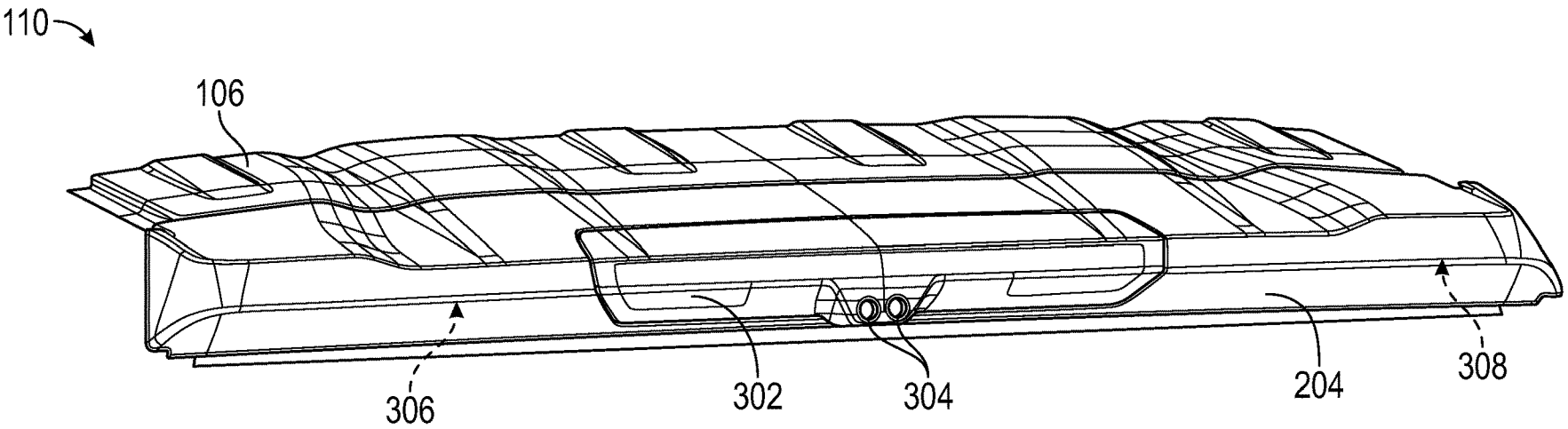
FIG. 3 shows the spoiler in a perspective view.

FIG. 3 shows the spoiler 110 of the vehicle 100 of FIG. 1 in a perspective view. The spoiler 110 includes a rear lighting system 302 and can also include rear cameras 304. The rear lighting system 302 separates the enclosed region 206 into a first cavity 306 on a left side of the vehicle 100 and a second cavity 308 on a right side of the vehicle 100.

Figure 4:
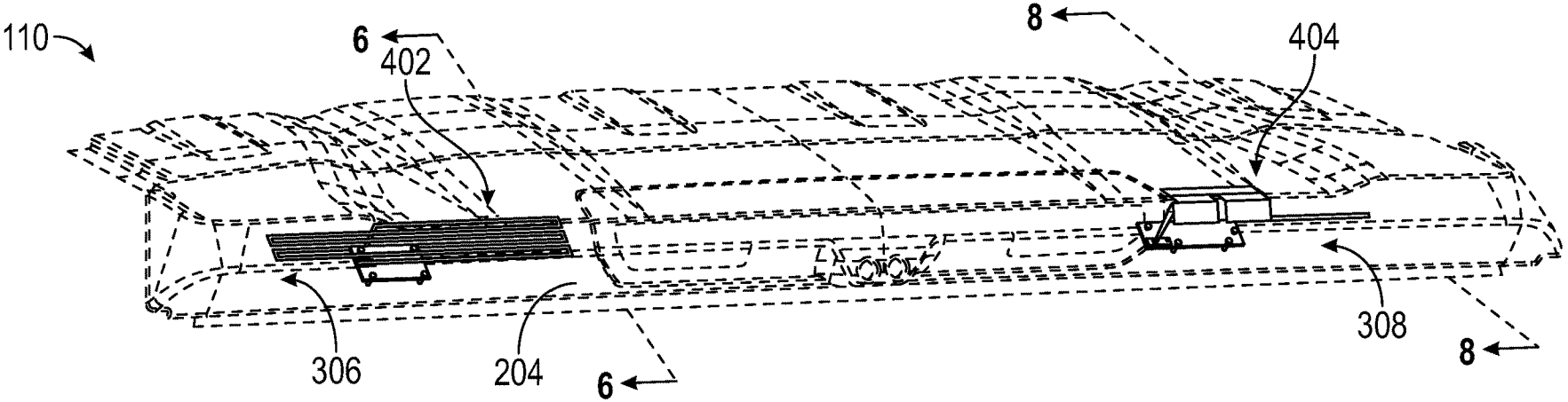
FIG. 4 shows a transparent perspective view of the spoiler.

FIG. 4 shows a transparent perspective view of the spoiler 110. FIG. 4 shows illustrative antenna assemblies that are enclosed by the cover 204 of the spoiler 110. The first cavity 306 includes a first antenna assembly 402 disposed therein, and the second cavity 308 includes a second antenna assembly 404 disposed therein. In various embodiments, the first antenna assembly 402 is an AM/FM radio frequency antenna and the second antenna assembly 404 is a digital audio broadcast (DAB) antenna. It is to be understood however that the types of antenna that can be housed in the spoiler 110 is not meant to be limited to these antennas disclosed herein. The antenna configuration for the first antenna assembly 402 is different from the antenna configuration for the second antenna assembly 404. Each antenna assembly can be contained within their respective cavities in their entirety.

Figure 5:
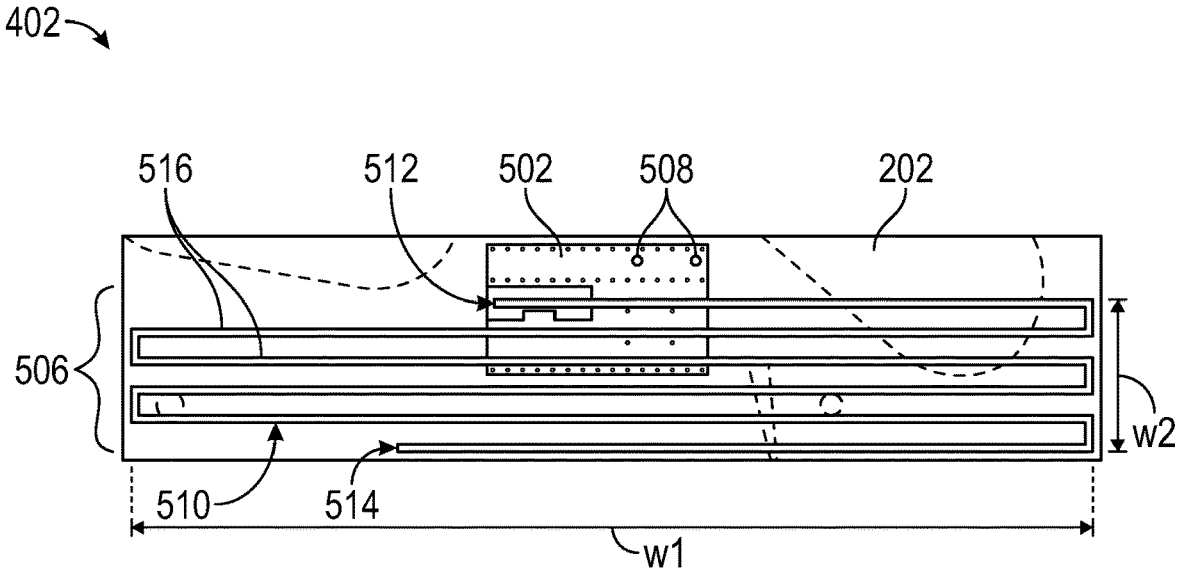
FIG. 5 shows a top plan view of as first antenna assembly disposed within a first cavity of the spoiler.
Figure 6:
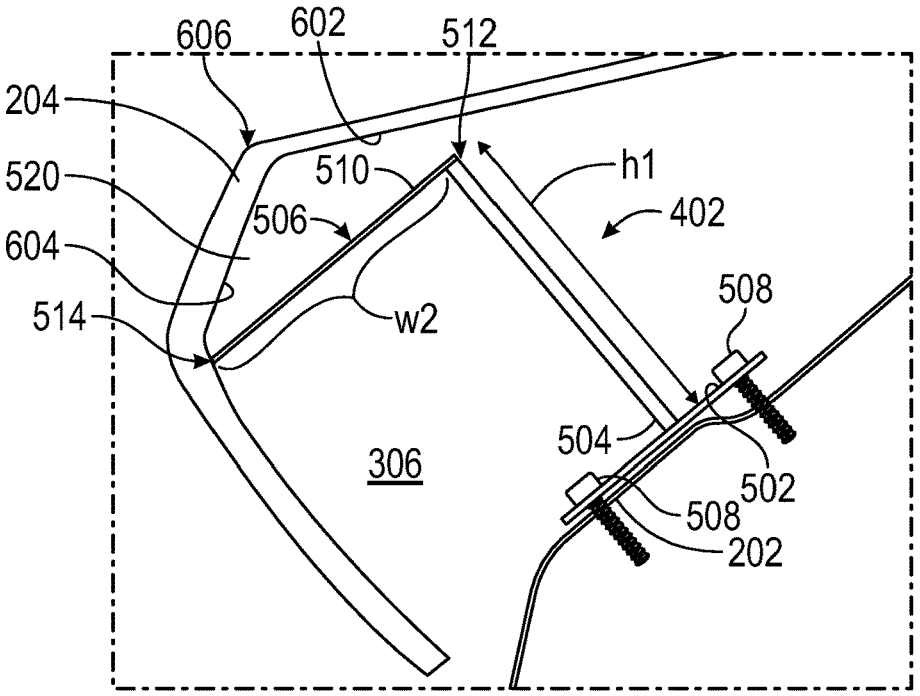
FIG. 6 shows a side-sectional view of the first antenna assembly within the first cavity taken at line 6-6 of FIG. 4.

FIG. 5 shows a top plan view of the first antenna assembly 402 disposed within the first cavity 306. FIG. 6 shows a side view of the first antenna assembly 402 within the first cavity 306. The first antenna assembly 402 includes a circuit board 502, a support beam 504 and an antenna 506. The support beam 504 and the antenna 506 are a continuous piece. The support beam 504 maintains the antenna 506 in a spaced apart relationship to the circuit board 502. The circuit board 502 includes various electrical components for operation of the first antenna assembly 402. The circuit board 502 is generally a flat or planar object and is attachable to the support surface 202 via one or more securing devices 508. The support beam 504 extends perpendicularly or orthogonally from the plane of the circuit board 502, and the antenna 506 is disposed at an end of the support beam 504 opposite the circuit board 502. Electrical wiring for the antenna 506 connects the circuit board 502 to the antenna 506 at a connection point between the support beam 504 and the circuit board 502. Since the support surface 202 is generally metallic, the support beam 504 supports or holds the antenna 506 at a height $h_1$ away from the support surface 202 that is as far away as possible from the support surface 202 given the constraints placed on the dimensions of the first cavity 306 by the cover 204.

The antenna 506 is a folded antenna that defines a rectangle having a length $w_1$ and a width $w_2$. The length $w_1$ is oriented along a line extending perpendicularly between the left side and right side of the vehicle 100. The antenna 506 includes an electrically conductive rod 510 extending from a first end 512 to a second end 514. The electrically conductive rod 510 is folded into a serpentine pattern including plurality of arms 516 extending lengthwise. The first end 512 of the electrically conductive rod 510 is connected to an end of the support beam 504 opposite the circuit board 502.

Referring to FIG. 6, as indicated, the support beam 504 extends perpendicularly or orthogonally from the plane of the circuit board 502 and has a height $h_1$. In various embodiments, the support beam 504 is also perpendicular or orthogonal to the plane of the antenna 506. The height $h_1$ of the support beam 504 is selected to hold the antenna 506 close to the cover 204 and away from the support surface 202. In various embodiments, the inner surfaces of the cover 204 are not parallel to the support surface 202 and are therefore not parallel to the plane of the antenna 506. FIG. 6 shows a cover 204 that includes a first inner surface 602 and a second inner surface 604 that meet at a corner 606. The first end 512 of the antenna 506 is placed near or against the first inner surface 602 and the second end 514 of the antenna is placed against the second inner surface 604. With the antenna 506 placed in this manner, there is nonetheless a gap between the antenna and the cover 204.

In an exemplary embodiment, the length of the antenna is $w_1$=29.2 cm and the width is $w_2$=4.60 cm. The height of the support beam is $h_1$=4.98 cm. The first antenna assembly 402 having these dimensions has operating frequencies between about 530 KHz and about 1710 KHz for the AM band and between about 76 MHz and about 108 MHz for the FM band. Compared with a conventional mast antenna which has a length of 78.7 cm, the antenna assembly 402 is compact and has a low profile.

Figure 7:
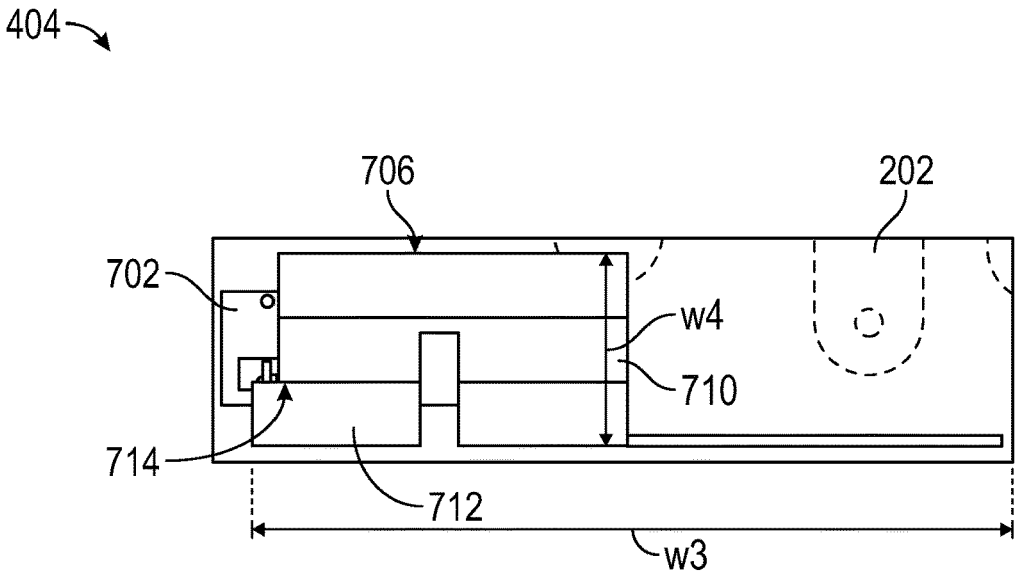
FIG. 7 shows a top plan view of a second antenna assembly disposed in a second cavity of the spoiler.
Figure 8:
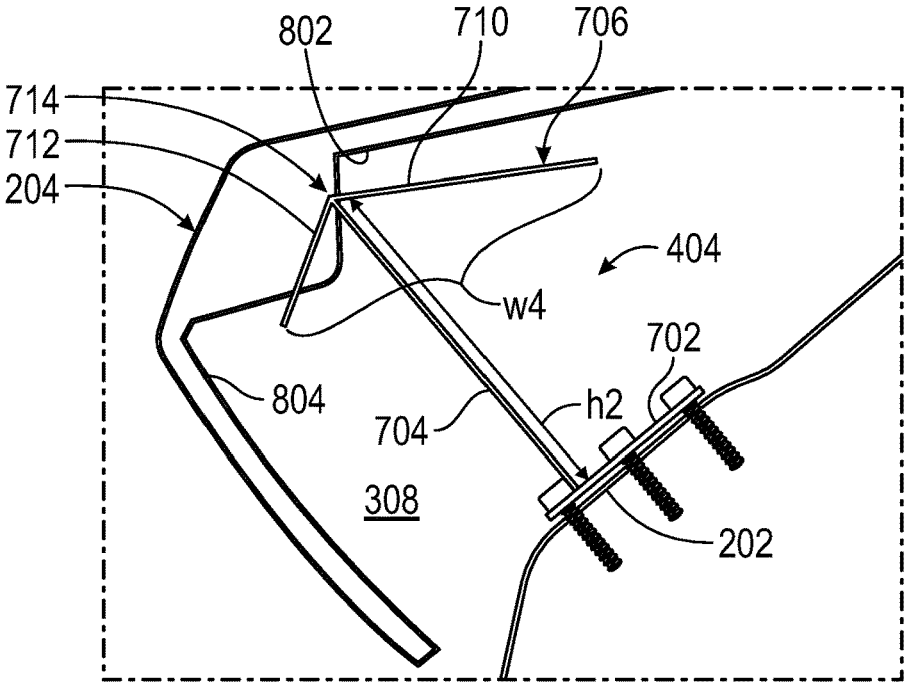
FIG. 8 shows a side-sectional view of the second antenna assembly in the second cavity taken at line 8-8 of FIG. 4.

FIG. 7 shows a top plan view 700 of the second antenna assembly 404 disposed in the second cavity 308. FIG. 8 shows a side view of the second antenna assembly 404 in the second cavity 308. The second antenna assembly 404 includes a circuit board 702, a support beam 704 and an antenna 706. The support beam 704 and the antenna 706 are a continuous piece. The support beam 704 maintains the antenna 706 in a spaced apart relationship to the circuit board 702. The circuit board 702 can include electrical components for operation of the second antenna assembly 404. The circuit board 702 is secured to the support surface 202 of the vehicle 100. The support beam 704 extends perpendicularly or orthogonally from a plane of the circuit board 702. The antenna 706 is disposed at an end of the support beam 704 opposite the circuit board 702. Electrical wiring for the antenna 706 connects the circuit board 702 to the antenna 706 at a connection point between the support beam 704 and the circuit board 702.

Referring to FIGS. 7 and 8, the antenna 706 includes a folded surface having a first side 710 and a second side 712 that meet at a vertex 714. As shown in the side view of FIG. 8, the antenna 706 is attached to the support beam 704 at the vertex 714. The first side 710 is disposed against or at a location near a first wall 802 of the cover 204 and the second side 712 is disposed near or against a second wall 804 of the cover.

The antenna 706 is a folded monopole with top loading. A length w3 of the antenna 706 is oriented along a line extending perpendicularly between the left side and right side of the vehicle 100. In one embodiment, the length of the antenna 706 is $w_3$=20.3 cm and the width is $w_4$=5.12 cm. The support beam has height $h_2$=5.66 cm. The second antenna assembly 404 having these parameters has operating frequencies in the DAB band between about 174 MHz and about 240 MHz. Considering its low operating frequency in comparison to a conventional DAB antenna assembly, the antenna 404 is compact and has a low profile.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. An antenna assembly for a vehicle, comprising:

a circuit board attachable to a support surface of a spoiler of the vehicle, the support surface forming a cavity with a cover of the spoiler;

a support beam extending from the circuit board; and an antenna at an end of the support beam opposite the circuit board, wherein the antenna is disposed within the cavity.

2. The antenna assembly of claim 1, wherein the antenna includes at least one of: (i) an AM/FM radio frequency antenna; and (ii) a digital audio broadcast (DAB) antenna.

3. The antenna assembly of claim 1, wherein the antenna extends along a length of the cavity.

4. The antenna assembly of claim 1, wherein the support beam supports the antenna at a location near the cover.

5. The antenna assembly of claim 1, wherein the support surface is at about a 45-degree angle from horizontal.

6. The antenna assembly of claim 1, wherein the antenna is a folded antenna.

7. The antenna assembly of claim 1, wherein the cover is one of: (i) electrically non-conductive; and (ii) electrically non-conductive with an electrically conductive layer of paint.

8. A spoiler for a vehicle, comprising:

a support surface;

a cover attachable to the support surface to form a cavity; and an antenna assembly disposed within the cavity, wherein the antenna assembly includes:

a circuit board attachable to the support surface;

a support beam extending from the circuit board; and an antenna at an end of the support beam opposite the circuit board, wherein the antenna is disposed within the cavity.

9. The spoiler of claim 8, wherein the antenna includes at least one of: (i) an AM/FM radio frequency antenna; and (ii) a digital audio broadcast (DAB) antenna.

10. The spoiler of claim 8, wherein the antenna extends along a length of the cavity.

11. The spoiler of claim 8, wherein the support beam supports the antenna at a location near the cover.

12. The spoiler of claim 8, wherein the antenna is a folded antenna.

13. The spoiler of claim 8, wherein the cover is one of: (i) electrically non-conductive; and (ii) electrically non-conductive with an electrically conductive layer of paint.

14. A vehicle, comprising:

a spoiler having a support surface and a cover attachable to the surface to form a cavity; and an antenna assembly disposed within the cavity, wherein the antenna assembly includes:

a circuit board attachable to the support surface;

a support beam extending from the circuit board; and an antenna at an end of the support beam opposite the circuit board, wherein the antenna is disposed within the cavity.

15. The vehicle of claim 14, wherein the antenna includes at least one of (i) an AM/FM radio frequency antenna; and (ii) a digital audio broadcast (DAB) antenna.

16. The vehicle of claim 14, wherein the antenna extends along a length of the cavity.

17. The vehicle of claim 14, wherein the support beam supports the antenna at a location near the cover.

18. The vehicle of claim 14, wherein the antenna is a folded antenna.

* * * * *